US009824584B2

(12) United States Patent
Kato

(10) Patent No.: US 9,824,584 B2
(45) Date of Patent: Nov. 21, 2017

(54) DRIVING SUPPORT APPARATUS FOR VEHICLE

(71) Applicant: TOYOTA JIDOSHA KABUSHIKI KAISHA, Toyota-shi (JP)

(72) Inventor: Mitsuharu Kato, Kasugai (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/271,938

(22) Filed: Sep. 21, 2016

(65) Prior Publication Data

US 2017/0092133 A1 Mar. 30, 2017

(30) Foreign Application Priority Data

Sep. 30, 2015 (JP) ..... 2015-195309

(51) Int. Cl.
*G08G 1/16* (2006.01)

(52) U.S. Cl.
CPC ..... *G08G 1/163* (2013.01)

(58) Field of Classification Search
CPC ..... G08G 1/163
See application file for complete search history.

(56) References Cited

U.S. PATENT DOCUMENTS 9,227,563 B2 * 1/2016 Hamdan ..... B60Q 1/525
2003/0025597 A1 * 2/2003 Schofield ..... B60Q 1/346 340/435
2006/0132295 A1 * 6/2006 Gern ..... B60Q 9/008 340/438
2007/0063874 A1 * 3/2007 Danz ..... B60Q 9/006 340/932.2
2008/0015772 A1 * 1/2008 Sanma ..... B60K 35/00 701/408

(Continued)

FOREIGN PATENT DOCUMENTS

JP 2008-186416 8/2008
JP 2015-46132 3/2015

*Primary Examiner* — Quang D Pham
(74) *Attorney, Agent, or Firm* — Oblon, McClelland, Maier & Neustadt, L.L.P.

(57) ABSTRACT

A driving support apparatus for a vehicle comprises a first determination part which determines whether a likelihood of a collision between an own vehicle and another vehicle exists based on information acquired by an autonomous sensor and outputs a first notification request when a notification for the likelihood of the collision is required, a second determination part which determinates whether the likelihood of the collision based on information acquired by an inter-vehicle communication device and GPS sensor and outputs a second notification request when the notification for the likelihood of the collision is required, a warning determination part which inhibits the output of the second notification request by the second determination part when a time at which starts outputting the second notification request for a notification device by the second determination part has come until the time period from a time treq1 at which starts outputting the first notification request for the notification by the first determination part. Consequently, the apparatus is less likely to bother and/or confuse a driver, since the notification contents are not switched in a short time.

2 Claims, 8 Drawing Sheets

(56) References Cited

U.S. PATENT DOCUMENTS

2009/0157268 A1* 6/2009 Chiba ..... G08G 1/168 701/53
2010/0082251 A1* 4/2010 Kogure ..... B60T 8/17558 701/301
2010/0094520 A1* 4/2010 Zagorski ..... B60T 7/22 701/70
2010/0217483 A1* 8/2010 Matsuno ..... G08G 1/165 701/36
2014/0009275 A1* 1/2014 Bowers ..... B60Q 1/00 340/436
2014/0139672 A1* 5/2014 Murashita ..... G08G 1/166 348/148
2014/0225722 A1* 8/2014 Takahashi ..... G08G 1/16 340/435
2014/0280657 A1* 9/2014 Miller ..... H04L 51/26 709/207
2014/0300464 A1* 10/2014 Chen ..... B60Q 1/46 340/471
2015/0066348 A1* 3/2015 Baba ..... G08G 1/166 701/301
2015/0169031 A1* 6/2015 DeLuca ..... G06F 1/3206 713/323
2015/0210279 A1* 7/2015 Agnew ..... B60W 30/09 701/48
2015/0248836 A1* 9/2015 Alselimi ..... G06K 9/00785 348/149
2015/0288640 A1* 10/2015 Lee ..... H04L 51/24 709/206
2015/0298692 A1* 10/2015 Minemura ..... B60W 30/08 701/70
2015/0321699 A1* 11/2015 Rebhan ..... B60Q 9/00 701/23
2016/0007405 A1* 1/2016 Ishihara ..... H04W 76/048 455/456.6
2016/0107643 A1* 4/2016 Mizutani ..... G01S 13/931 701/519
2016/0114800 A1* 4/2016 Shimizu ..... B60W 30/0956 701/70
2016/0127451 A1* 5/2016 Yerli ..... H04L 65/60 709/203
2016/0155329 A1* 6/2016 Goto ..... G08G 1/096791 340/903
2016/0205246 A1* 7/2016 Sim ..... H04L 67/125 455/419
2016/0214609 A1* 7/2016 Yamaoka ..... B60W 30/16

* cited by examiner

DRIVING SUPPORT APPARATUS FOR VEHICLE

TECHNICAL FIELD

The present invention relates to a driving support apparatus for a vehicle. The apparatus provides a notification that the vehicle (own vehicle) is likely to collide with another vehicle by using information on a position and a speed of the another vehicle acquired by an inter-vehicle communication device.

BACKGROUND ART

Conventionally, a driving support apparatus for a vehicle is known, which estimates a likelihood of a collision with another vehicle based on the another vehicle information (hereinafter, referred to as "autonomous sensor information") which includes a position, a direction, a speed, or the like of the another vehicle measured by an automotive radar, an on-vehicle camera, or the like, and information which includes a position, a travel direction, a speed, or the like of the vehicle (own vehicle), and notifies a driver in advance that the likelihood of the collision if the collision is likely to occur. The driving support apparatus can effectively prevent a vehicle collision at an intersection. Although the automotive radar, the on-vehicle camera, or the like can acquire the autonomous sensor information at a good-visibility intersection, however, they sometimes cannot acquire the autonomous sensor information at a bad-visibility intersection around which there are buildings, trees, or the like.

On the other hand, if each of an own vehicle and another vehicle is equipped with the inter-vehicle communication device, information on the another vehicle such as a position, a direction, a speed, or the like of the another vehicle, that are acquired by a GPS sensor, a speed sensor, or the like, equipped with the another vehicle, can be acquired via the inter-vehicle communication devices. Hereinafter, the information on the another vehicle which is acquired via the inter-vehicle communication devices is referred to as "communicated another vehicle information".

Accordingly, one of conventional driving support apparatuses (hereinafter, referred to as a "conventional apparatus") estimates a likelihood of a collision in advance based on not only the autonomous sensor information but also the communicated another vehicle information, and notify the driver of the likelihood of the collision when the collision is likely to occur (for example, refer to Japanese Patent Application Laid-Open (kokai) No. 2008-186416).

Nevertheless, the communicated another vehicle information is generally not so accurate as the autonomous sensor information, since the communicated another vehicle information is information acquired based on the GPS signals. Thus, there may occur a situation where an estimated collision time (in actuality, a time to collision) with respect to a specific another vehicle calculated based on (using) the communicated another vehicle information is slightly different from an estimated collision time with respect to the specific another vehicle calculated based on (using) the autonomous sensor information.

In this case, if the notification (e.g., a display of images, a generation of sounds, or the like) that the "collision is likely to occur" based on respective information is provided, the notified contents are switched over within a short time, and a display of images becomes unstable. This may bother and/or confuse the driver.

SUMMARY OF INVENTION

The present invention is made to solve the problem mentioned above. That is, one of the objects of the present invention is to provide a driving support apparatus, which is configured to provide a notification of a collision likelihood based on each of the autonomous sensor information and the communicated another vehicle information, and is less likely to bother and/or confuse the driver due to the switching over of the notification contents in a short time.

A driving support apparatus of the present invention (hereinafter, referred to as a "present invention apparatus") comprises an autonomous sensor (10), a first determination part (60, 61), an inter-vehicle communication device (20), own vehicle position acquisition means (30), own vehicle speed detection means (40), a second determination part (60, 62), and notification means (50, 60, 63).

The autonomous sensor acquires information including "a position of another vehicle (i.e., a relative position) and a speed of the another vehicle (i.e., a relative speed)" relative to an own vehicle without using information from the another vehicle and/or an infrastructure. The autonomous sensor, for example, includes a millimeter-wave radar (11), a stereo camera (12), or the like, provided on the own vehicle, but is not limited thereto, as long as the autonomous sensor can acquire the relative position and the relative speed of the another vehicle.

The first determination part uses the position and the speed of the another vehicle acquired by the autonomous sensor to determine whether a first notification point in time has come (Step 610 to Step 660). The first notification point in time is a point in time at which a notification that a likelihood of a collision between the own vehicle and the another vehicle exists is provided. The first determination part generates a first notification request when it is determined that the first notification point in time has come (Step 670). The first determination part is also referred to as an autonomous warning part.

The inter-vehicle communication device acquires, from the another vehicle through wireless communication, information including a position of the another vehicle which is acquired based on GPS signals received by the another vehicle and a speed of the another vehicle. It should be noted that the inter-vehicle communication device may acquire not only the position and the speed of the another vehicle, but also an acceleration and a deceleration of the another vehicle.

The own vehicle position acquisition means receives GPS (Global Positioning System) signals transmitted from GPS satellites, and acquires a position of the own vehicle based on the GPS signals. It should be noted that the GPS signals of the present invention include signals for specifying the position which are transmitted from GNSS (Global Navigation Satellite System) satellites and/or QZSS (Quasi Zenith Satellite System) satellites. The own vehicle speed detection means detects a speed of the own vehicle. The own vehicle speed detection means may include, for example, a vehicle speed sensor, or a wheel rotational speed sensor.

The second determination part uses the position and the speed of the another vehicle acquired by the inter-vehicle communication device, the position of the own vehicle acquired by the own vehicle position acquisition means, and the speed of the own vehicle detected by the own vehicle speed detection means to determine whether a second notification point in time has come (Step 710 to Step 770). The second notification point in time is a point in time at which a notification that a likelihood of a collision between the own vehicle and the another vehicle exists is provided. The second determination part generates a second notification request when it is determined that the second notification point in time has come (Step 780). The second determination part is also referred to as an inter-vehicle communication type warning part.

The notification means provides a notification according to the first notification request at the first notification point in time (Step 835), and provides a notification according to the second notification request at the second notification point in time (Step 850).

As mentioned above, the autonomous sensor information such as the relative position and the relative speed of another vehicle detected by the autonomous sensor of the own vehicle is generally more accurate than the communicated another vehicle information acquired based on GPS signals, and has a shorter detection time interval (information update interval) compared with the communicated another vehicle information acquired based on GPS signals. Therefore, a point in time at which a determination that the likelihood of the collision with a specific another vehicle exists is made based on the autonomous sensor information may be different from a point in time at which a determination that the likelihood of the collision with the specific another vehicle exists is made based on the communicated another vehicle information. In this case, if the notification according to the first notification request and the second notification request are provided, the driver of the own vehicle may be bothered or confused.

In view of the above, the notification means is configured not to provide the notification according to the second notification request at the second notification point in time (Step 825, "No" determination at Step 840), but to provide the notification according to the first notification request at the first notification point in time (Step 835), if the second notification point in time (Treq2) has come in a period from a point in time earlier than the first notification point in time (Treq1) by a predetermined time length (a) to the first notification point in time.

According to the configuration above, the likelihood of the collision estimated by the second determination part is not notified, when the second notification point in time is earlier than (before) the first notification point in time, and the difference between the second notification point in time and the first notification point in time is equal to or less than the predetermined time length. That is, the present invention apparatus can avoid the situation where the notification which is provided for a short time by the second notification determination part bothers and/or confuses the driver, when the difference between the second notification point in time and the first notification point in time is equal to or less than the predetermined time length.

Furthermore, it is preferable that the first determination part be configured to calculate the first time to collision which is the time until (time length from the present point in time to a point in time at which) the own vehicle collides with the another vehicle based on the position and the speed of the another vehicle acquired by the autonomous sensor(s) (Step 650). A time to collision (hereinafter, sometimes referred to as a "TTC (Time-To-Collision)"), for example, may be calculated by dividing a relative distance between the own vehicle and the another vehicle by a relative speed between the own vehicle and the another vehicle. In other words, TTC is a remaining time until the point in time at which the own vehicle collides with the another vehicle.

Further, it is preferable that the first determination part be configured to determine ("Yes" determination at Step 660) that the first notification point in time has come, when the first time to collision becomes equal to or less than a predetermined first threshold time.

In addition, it is preferable that the second determination part be configured to calculate the second time to collision (Step 760) which is the time until (time length from the present point in time to a point in time at which) the own vehicle collides with the another vehicle based on the position and the speed of the another vehicle acquired by the inter-vehicle communication device, the position of the own vehicle acquired by the own vehicle position acquisition means, and the speed of the own vehicle detected by the own vehicle speed detection means.

Furthermore, it is preferable that the second determination part be configured to determine ("Yes" determination at Step 770) that the second notification point in time has come, when the second time to collision becomes equal to or less than a predetermined second threshold time.

In this way, the first determination part calculates the first time to collision, and the second determination part calculates the second time to collision. Thus, the notification means can easily determine whether the second notification point in time comes within the period from the point in time which is earlier than the first notification point in time by a predetermined time length to the first notification point in time, based on those times to collision and the threshold times, each corresponding to the respective time to collision.

In the above description, references used in the following descriptions regarding embodiments are added with parentheses to the elements of the present invention, in order to assist in understanding the present invention. However, those references should not be used to limit the scope of the invention. Other objects, other features, and accompanying advantages of the present invention will be readily understood from the description of embodiments of the present invention to be given referring to the following drawings.

DESCRIPTION OF EMBODIMENTS

Hereinafter, a driving support apparatus for a vehicle according to an embodiment of the present invention (hereinafter, referred to as the "present support apparatus") will be described with reference to the drawings.

(Configuration)

Figure 1:
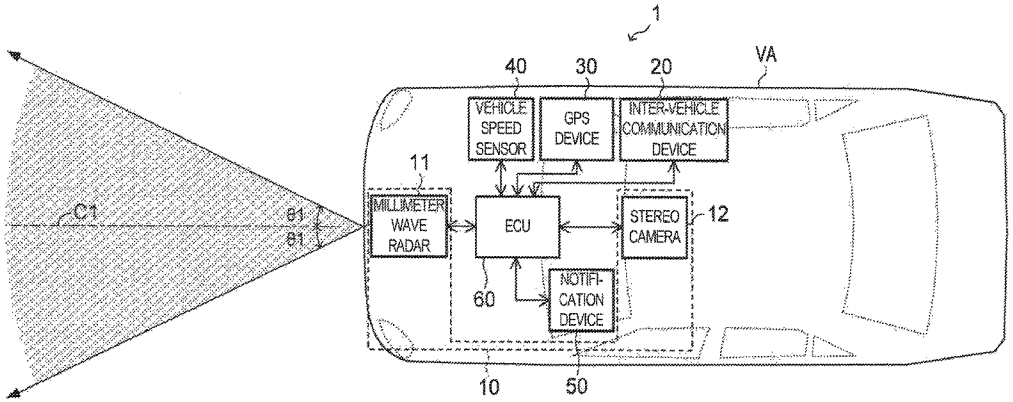
FIG. 1 is a schematic diagram for illustrating a vehicle and a driving support apparatus for a vehicle to which the driving support apparatus according to an embodiment of the present invention is applied.

The present support apparatus 1 is provided to a vehicle (automobile) VA, as shown in FIG. 1. In the following description, a vehicle focused on may be referred to as an own vehicle. The present support apparatus 1 comprises an autonomous sensor 10, an inter-vehicle communication device 20, a GPS device 30, a vehicle speed sensor 40, a notification/alarm device 50, and an electronic control unit (ECU) 60.

The autonomous sensor 10 includes a millimeter-wave radar 11 and a stereo camera 12. The millimeter-wave radar 11 is positioned at front side of the vehicle (e.g., inside of a front grille). The millimeter-wave radar 11 is radar which has directional characteristics, and uses electromagnetic waves (millimeter waves) having a carrier frequency of 76-GHz band, which is so-called millimeter-wave band. The millimeter-wave radar 11 is configured to detect objects inside a detectable area (within a range of 2θ1 in the figure) while sequentially changing an irradiated area of the electromagnetic waves.

More specifically, the millimeter waves which are transmitted from the millimeter-wave radar 11 are reflected by a target object (e.g., another vehicle). A transmitter-and-receiver of the millimeter waves receives the reflected waves. The electronic control unit 60 measures (acquires) a distance between the target object and the own vehicle, a direction of the target object with respect to the own vehicle (i.e., a relative direction), a speed of the target object with respect to the own vehicle (i.e., a relative speed), or the like, based on a phase difference between the transmitted millimeter waves and the received reflected waves, an attenuation level of the reflected waves, and a time period from a point in time at which the millimeter waves are transmitted to a point in time at which the millimeter waves are received. It is difficult for the millimeter-wave radar 11 to detect an object located at the other side of a shielding object, since the millimeter-wave radar 11 has the directional characteristics. It should be noted that the carrier frequency band of the millimeter-wave radar 11 may be 60-GHz band, 79-GHz band, or the like. A radar which is equipped as the autonomous sensor 10 may be a laser radar.

The stereo camera 12, for example, is positioned at a compartment (passenger room) side of a front window. The stereo camera 12 includes two CCD cameras and a processor. The processor acquires a "relative position, a relative speed, a relative direction, or the like" of the target object by performing image processing with respect to the image taken by the two cameras. It is difficult for the stereo camera 12 to detect an object located at the other side of a shielding object. It should be noted that the camera which is equipped as the autonomous sensor 10 may be a monocular camera.

The inter-vehicle communication device 20 is configured to receive information on a position of the another vehicle which is acquired by a GPS device of the another vehicle, a speed of the another vehicle which is acquired by a vehicle speed sensor of the another vehicle, or the like, through wireless communication. The inter-vehicle communication device 20 is configured to transmit information on a position of the own vehicle which is acquired by the GPS device of the own vehicle (described later), a speed of the own vehicle which is acquired by a vehicle speed sensor on the own vehicle (described later), or the like, to the outside of the own vehicle.

The GPS device 30 is configured to acquire GPS information which includes the position of the own vehicle, a travel direction of the own vehicle, or the like, based on an information (i.e., GPS signals) transmitted from GPS satellites.

The vehicle speed sensor 40 is configured to generate an output signal which represents a speed of the own vehicle (an own vehicle speed).

The notification (alarm) device 50 includes, for example, a display which is positioned within a visible location from a driver's sheet, and a sounding device. The notification device 50 is configured to display an appropriate information and sound according to a request (an instruction signal) from the electronic control unit 60.

The ECU 60 is well known electronic circuitry which comprises a microcomputer including a CPU, a ROM, a RAM, an interface I/F, or the like. The ECU is an abbreviation for an electronic control unit. The CPU realizes various functions described below by executing instructions (routines) stored in a memory (the ROM).

The electronic control unit 60 is electrically connected with the millimeter-wave radar 11, the stereo camera 12, the inter-vehicle communication device 20, the GPS device 30, the vehicle speed sensor 40, or the like, and is configured to receive (input) signals from the each device. The electronic control unit 60 is electrically connected with the notification device 50 and is configured to transmit the requests (instruction signals) to the notification device 50 according to the instructions from the CPU.

Figure 2:
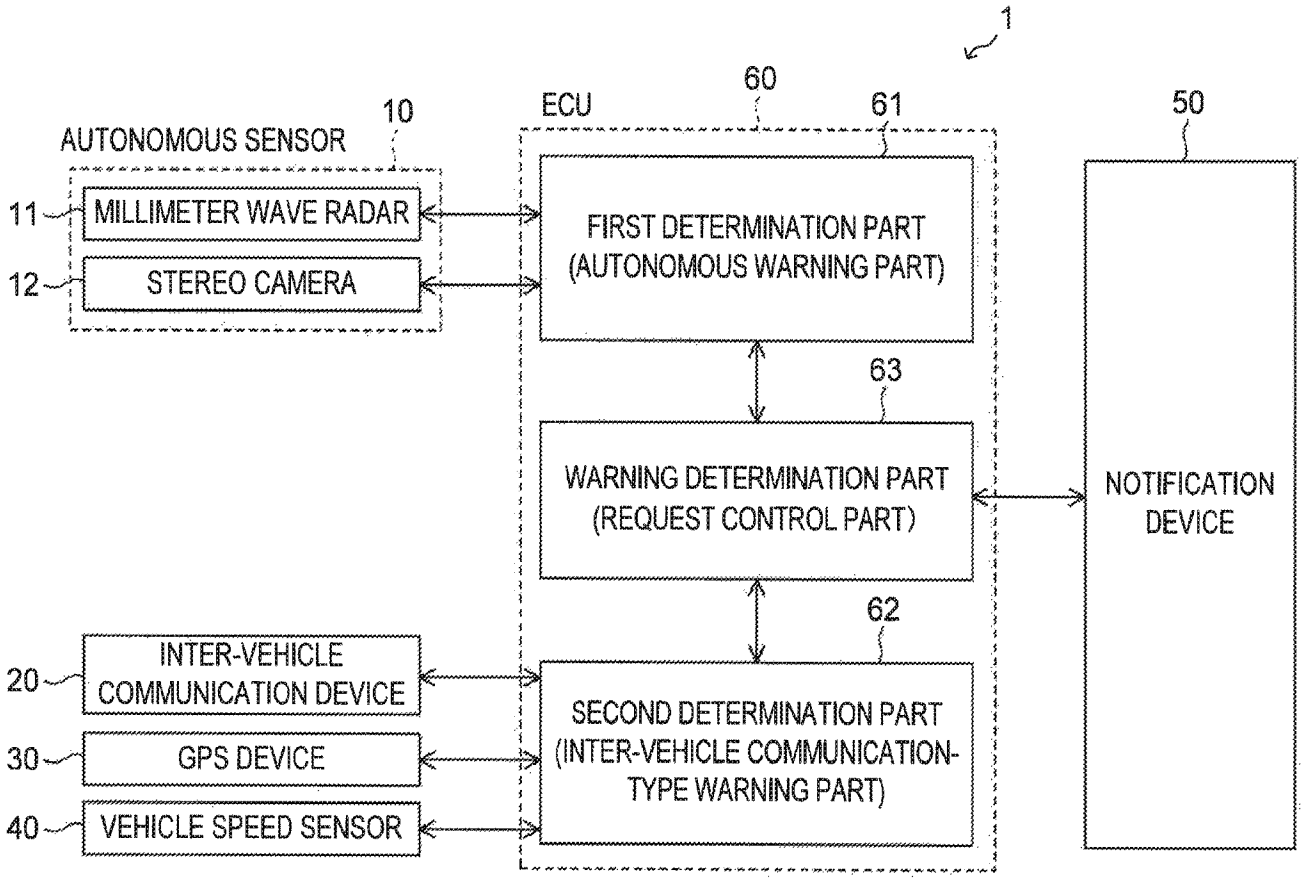
FIG. 2 is a block diagram for illustrating a function which is achieved by a CPU of the electronic control unit shown in FIG. 1.

The electronic control unit 60 is configured to realize various functions shown in FIG. 2 by executing the routines which are stored in the ROM. More specifically, the electronic control unit 60 is configured to realize the functions of a first determination part (section) 61, a second determination part (section) 62, and a warning determination part (section) 63.

The first determination part 61 is configured to acquire "the position (relative position), the relative direction, and the relative speed, or the like" of the another vehicle, which are acquired by using the autonomous sensor 10 of the another vehicle, and provide a warning/alert to a driver (draw a driver's attention) based on the autonomous sensor information. Thus, the first determination part 61 is referred to as an autonomous warning part. That is, the first determination part 61 is configured to calculate a variation (change amount) of the relative position and a variation of the relative speed, using the autonomous sensor information, and determine whether there is a likelihood of an collision between the own vehicle and the another vehicle (a first likelihood of an collision) based on these variations.

More specifically, the first determination part 61 is configured to determine that the likelihood of the collision exists when a predicted arrival position of the another vehicle at an arbitrary time t exists within a range determined based on a predicted arrival position of the vehicle VA at that time t (a range of vehicle position), and determine that no likelihood of the collision exists when the predicted arrival position of the another vehicle does not exist within the range of vehicle position. The predicted method of a likelihood of a collision is well-known, and is described in, for example, Japanese Patent Application Laid-Open (kokai) No. 2015-46132.

The first determination part 61 is configured to calculate a time to collision TTC when it determines that the first likelihood of a collision exists. Hereinafter, the TTC calculated by the first determination part 61 is referred to as a first time to collision TTC1.

The first determination part 61 is configured to generate a notification request (a first notification request) to provide a warning/alert to the driver of the vehicle, when the first time to collision TTC1 becomes a predetermined first threshold time TTC1*th* or less. Hereinafter, the time to output the notification request is referred to as a "first notification point in time". That is, the first determination part 61 is configured to determine, using the autonomous sensor information, whether the first notification point in time has come, the notification point in time being a point in time at which the notification/warning of the likelihood of the collision between the own vehicle and the another vehicle exists should be provided, and to generate the first notification request when the first notification point in time has come.

The second determination part 62 is configured to acquire the information (i.e., communicated another vehicle information) on the position, the speed, or the like of another vehicle using the inter-vehicle communication device 20, and acquire the information on the position, the speed, or the like of the own vehicle (hereinafter, referred to as "own vehicle information") using the GPS device 30 and/or the vehicle speed sensor 40. The second determination part 62 is configured to provide a warning to the driver based on the acquired the communicated another vehicle information and the acquired own vehicle information. Thus, the second determination part 62 is referred to as an inter-vehicle communication type warning part. That is, the second determination part 62 is configured to calculate a variation of the relative position and a variation of the relative speed using the communicated another vehicle information and the own vehicle information at first, and determine whether the likelihood of an collision (a second likelihood of an collision) between the own vehicle and the another vehicle exists based on these variations. This method for predicting the likelihood of a collision is similar to the method which the first determination part 61 uses except that the acquisition sources for the parameters used for the prediction are different.

The second determination part 62 is configured to calculate a time to collision TTC when it determines that the second likelihood of a collision exists. Hereinafter, the TTC calculated by the second determination part 62 is referred to as a second time to collision TTC2. The second determination part 62 is configured to generate a notification request (a second notification request) to provide a warning/alert to the driver of the vehicle, when the second time to collision TTC2 becomes a predetermined second threshold time TTC2*th* or less.

Hereinafter, the time to output the notification request is referred to as a "second notification point in time". That is, the second determination part 62 is configured to determinate whether the second notification point in time has come using the communicated another vehicle information and the own vehicle information, the notification point in time being a point in time at which the notification/warning of the likelihood of the collision between the own vehicle and the another vehicle exists should be provided, and to generate the second notification request when the second notification point in time has come.

The warning determination part 63 is configured to transmit the first notification request from the first determination part 61 and the second notification request from the second determination part 62 to the notification device 50. Thus, the notification device 50 is configured to provide the notification (displaying the warning on the display) according to the first notification request at the first notification point in time, and provide the notification (displaying the warning on the display) according to the second notification request at the second notification point in time. However, the warning determination part 63 is configured not to send the second notification request to the notification device 50 at the second notification point in time when the second notification point in time has come for/within a period from a point in time earlier than the first notification point in time by a predetermined time length to the first notification point in time. In contrast, the warning determination part 63 is configured to send the first notification request to the notification device 50 at the first notification point in time. Consequently, the notification device 50 does not provide the warning according to the second notification request at the second notification point in time, but provides the warning according to the first notification request at the first notification point in time.

Figure 3:
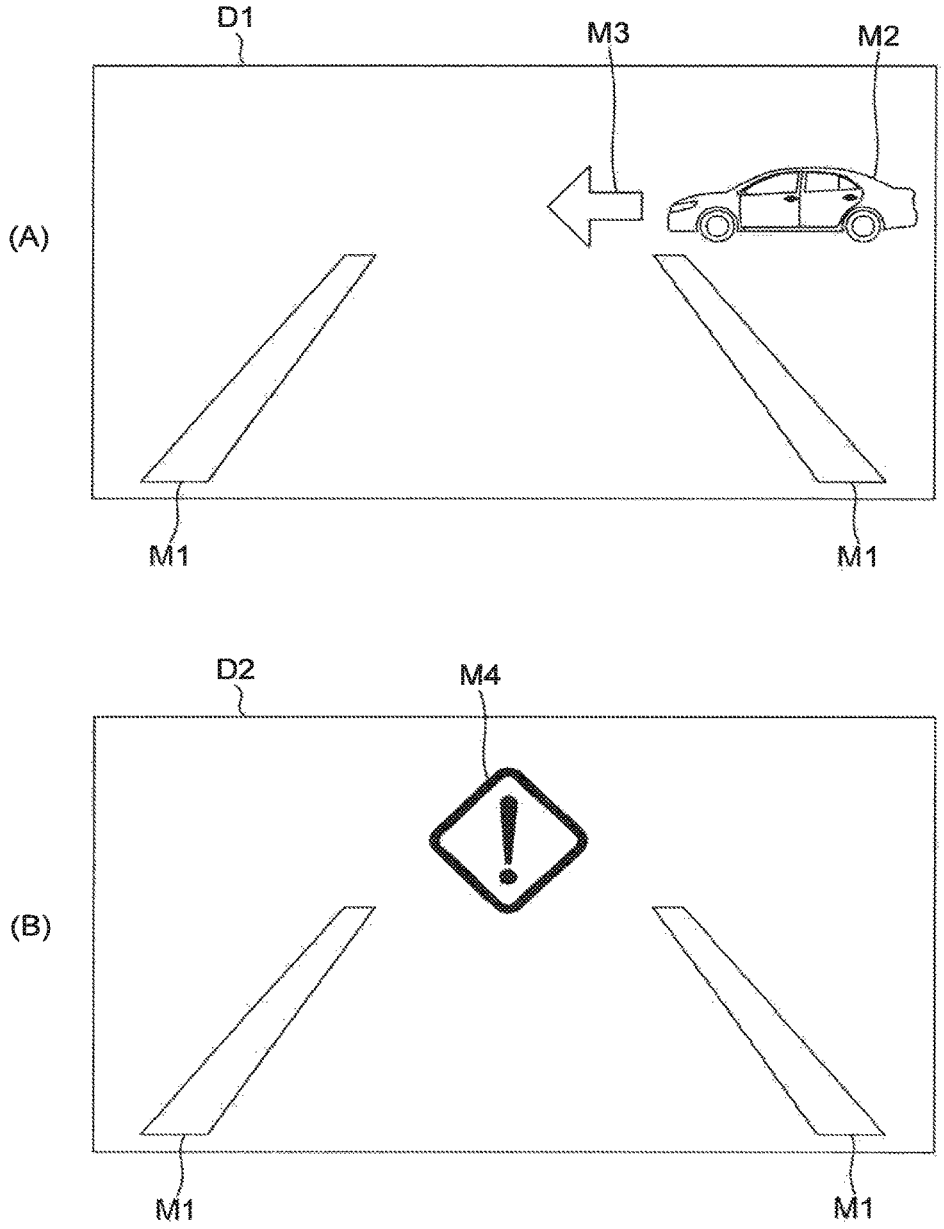
FIG. 3 is a diagram for illustrating an example of a screen displayed on a notification device shown in FIG. 1.

Examples of a collision warning displayed on the display of the notification device 50 are shown in FIGS. 3 (A) and 3 (B). By the collision warning, symbols (marks) M1 of a road on which the own vehicle is traveling are displayed from a driver's view.

On the "screen D1 displayed in accordance with the first notification request" shown in FIG. 3 (A), a "position of another vehicle with which the own vehicle is likely to collide" is expressed by a "vehicle body symbol M2 representing a vehicle body", and the traveling direction of the another vehicle is expressed by an arrow M3. FIG. 3 shows a situation where another vehicle is traveling toward a center of an intersection from a right side of the intersection.

On the "screen D2 displayed in accordance with the second notification request" shown in FIG. 3 (B), the road symbols M1 and an alarm symbol M4 expressing that the likelihood of a collision with another vehicle exists are displayed. On the screen D2 in accordance with the second notification request, only the alarm symbol M4 is displayed, since it is difficult to accurately specify the position of the another vehicle in a case where the second notification request is sent as compared to a case where the first notification request is sent.

It should be noted that the notification device 50 may be configured to provide not only the warning using the display but also alarm sound and/or voice using sound device such as a speaker.

(Operation)

As described above, the first determination part 61 generates the first notification request when the first time to collision TTC1 becomes equal to or shorter than the first threshold time TTC1*th*. In actuality, the first determination part 61 generates the first notification request when all of the following conditions are satisfied, in addition to the above condition concerning the first time to collision TTC1. That is, a first notification request generation condition (autonomous type supporting condition) is satisfied, when all of the following conditions are satisfied.

(A1) The autonomous sensor 10 (i.e., the millimeter wave radar 11 and the stereo camera 12) are not in failure.

(A2) The autonomous sensor 10 is detecting a moving object such as another vehicle.

(A3) The first time to collision TTC1 becomes equal to or less than the first threshold time TTC1*th*.

It should be noted that above-mentioned conditions (A1) and (A2) are preconditions for the first notification request.

Similarly, the second determination part 62 generates the second notification request when the second time to collision TTC2 becomes equal to or less than the second threshold time TT2*th*. In actuality, the second determination part 62 generates the second notification request when all of the following conditions are satisfied, in addition to the above condition concerning the first time to collision TTC2. That is, a second notification request generation condition (an inter-vehicle type supporting condition) is satisfied, when all of the following conditions are satisfied.

(B1) The GPS device 30 and the vehicle speed sensor 40 are not in failure.

(B2) The inter-vehicle communication device 20 has established the communication with another vehicle.

(B3) The autonomous type supporting (the notification for the warning the driver based on the first notification request) is not being performed.

(B4) The second time to collision TTC2 becomes equal to or less than the second threshold time TTC2*th*.

It should be noted that above-mentioned conditions (B1) to (B3) are preconditions of the second notification request.

Next, an operation (a notification) for warning the driver, the operation being performed by the CPU of the electronic control unit 60 concerning a collision between vehicles in an intersection (a crossing collision) will be described with reference to FIG. 4 and FIG. 5.

Figure 4:
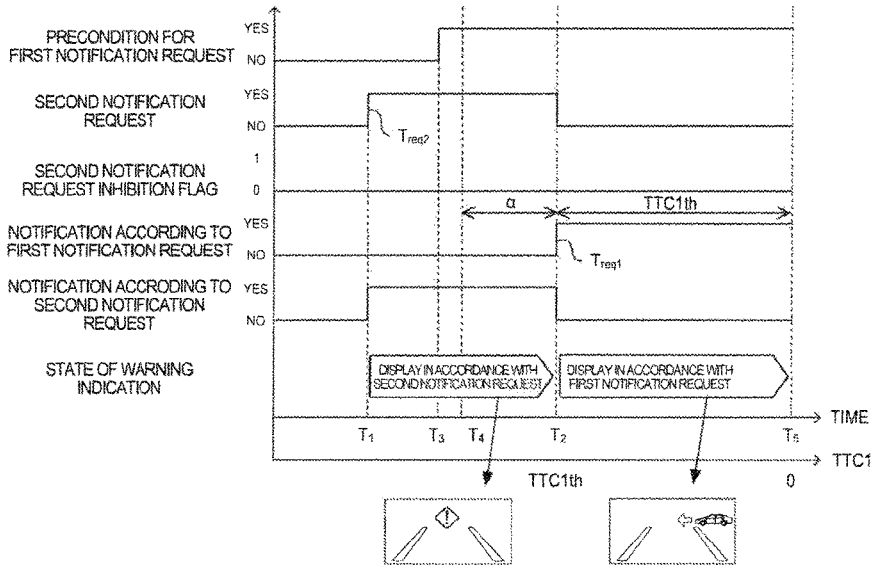
FIG. 4 is a timing chart for showing operations of a first determination part, a second determination part, and a warning determination part of a driving support apparatus shown in FIG. 1 in a case where a notification request is generated by the second determination part at a relatively short time.

In an example shown in FIG. 4, the second notification request generation condition is satisfied at the time T1 when the second time to collision TTC2 becomes equal to the second threshold time TTC2*th* at the time T1. That is, the time T1 is the time Treq2 when the second notification request is generated. Consequently, the second notification request is generated at the time T1, and thus, the notification (the display) according to the second notification request has been provided from the time T1.

Thereafter, the preconditions of the first notification request (condition (A1) and condition (A2)) are satisfied at the time T3. Consequently, the first determination part 61 calculates the first time to collision TTC1. However, the first determination part 61 does not generate the first notification request, since the time to collision TTC1 calculated at the time T3 is longer than the first threshold time TTC1*th*.

Thereafter, the first time to collision TTC1 becomes equal to the first threshold time TTC1*th* at the time T2. Therefore, the first determination part 61 generates the first notification request at the time T2. That is, the time T2 is the time Treq1 at which the first notification request is generated. Consequently, the notification (the display) according to the first notification request has been generated from the time T1. The condition (B3) which is one of the preconditions for the second notification request is not satisfied when the notification according to the first notification request is being provided. Thus, the second notification request disappears at the time T3, and consequently, the display according to the second notification request becomes not provided.

In the example shown in FIG. 4, the time Treq2 (i.e., time T1) at which the second notification request is generated is earlier than the time T4 which is earlier than the time Treq1 (i.e., time T2) at which the first notification request is generated, by the predetermined time length α. In other words, the first notification request is not generated even if the predetermined time length α elapses from the time Treq2 at which the second notification request started to be generated. The "predetermined time length α" is set at a time length (e.g., two seconds) that is long enough not to bother or confuse the driver even when the contents displayed on the notification device 50 change (switch) over from the notification (the display) according to the second notification request to the notification (the display) according to the first notification request".

Figure 5:
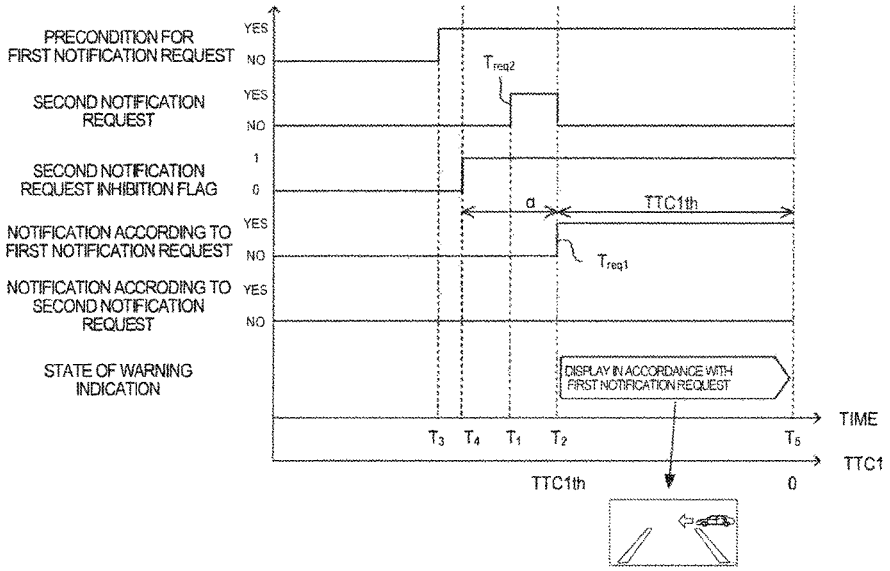
FIG. 5 is a timing chart for showing operations of the first determination part, the second determination part, and the warning determination part of the driving support apparatus shown in FIG. 1 in a case where a notification request by a second determination part is generated at a relatively long time.

On the other hand, in the example shown in FIG. 5, the preconditions for the first notification request are satisfied at the time T3. Thus, the first determination part 61 calculates the first time to collision TTC1. However, the first determination part 61 does not generate the first notification request, since the first time to collision TTC1 calculated at the time T1 is longer than the first threshold time TTC1*th*.

Thereafter, at the time T4, the first time to collision TTC1 becomes equal to the time obtained by adding the predetermined time length α to the first threshold time TTC1*th* (TTC1*th*+α). At this time, the warning determination part 63 sets a second notification request inhibition flag to "1". When the second notification request inhibition flag is "1", the notification according to the second notification request is inhibited even if the second notification request is generated.

Thereafter, the second notification request generation condition is satisfied at the time T1. That is, the time T1 is the time Treq2 at which the second notification request is generated. However, the notification according to the second notification request is not provided, since the second notification request inhibition flag is "1".

The first time to collision TTC1 becomes equal to the first threshold time TTC1*th* at the time T2 after time further passes. Therefore, the first determination part 61 generates the first notification request at the time T2. That is, the time T2 is the time Treq1 at which the first notification request is generated. Consequently, the notification (the display) according to the first notification request has been provided from the time T2. When the notification according to the first notification request is provided, the condition (B3) which is one of the preconditions for the second notification request is not satisfied. Thus, the second notification request disappears at the time T2.

In the example shown in FIG. 5, the time Treq2 (i.e., time T1) at which the second notification request is generated, is after the time T4 which is earlier than the time Treq1 (i.e., time T2) at which the first notification request is generated, by the predetermined time length α. In other words, the first notification request is generated before the predetermined time length α elapses from the time Treq2 at which the second notification request has been generated. Thus, if the notification (the display) according to the second notification request is provided, that notification according to the second notification request is switched (changed) to notification (the display) according to the first notification request within the predetermined time length α. This may bother and/or confuse the driver. Therefore, as the example shown in FIG. 5, the notification (the display) according to the second notification request is inhibited in such a case.

In this way, the notification according to the second notification request is not provided, but the notification according to the first notification request is provide, when the time length from the time Treq1 at which the first notification request is generated to the time Treq2 at which the second notification request is generated is shorter than the "predetermined time length α". On the other hand, the notification according to the second notification request and the notification according to the first notification request are both provided, when the time length from the time Treq1 at which the first notification request is generated to the time Treq2 at which the second notification request is generated is longer than the "predetermined time length α". It should be noted that the notification according to the first notification request is provided in place of the notification according to the second notification request, when the first notification request is generated while the notification according to the second notification request is being provided, since the first notification request is prioritized, compared to the second notification request. Furthermore, the notification according to the first notification request is continued and the notification according to the second notification request is not provided, when the second notification request is generated while the notification according to the first notification request is being provided.

(Actual Operation)

Next, a detailed description will be given of the actual operation of the present support device 1. As described above, the support device 1 is functionally separated into the first determination part 61, the second determination part 62, and the warning determination part 63. Firstly, a detailed description will be given of the operation of the first determination part 61.

(First Notification Request Generation Routine: Autonomous Support Execution Determination Routine)

Figure 6:
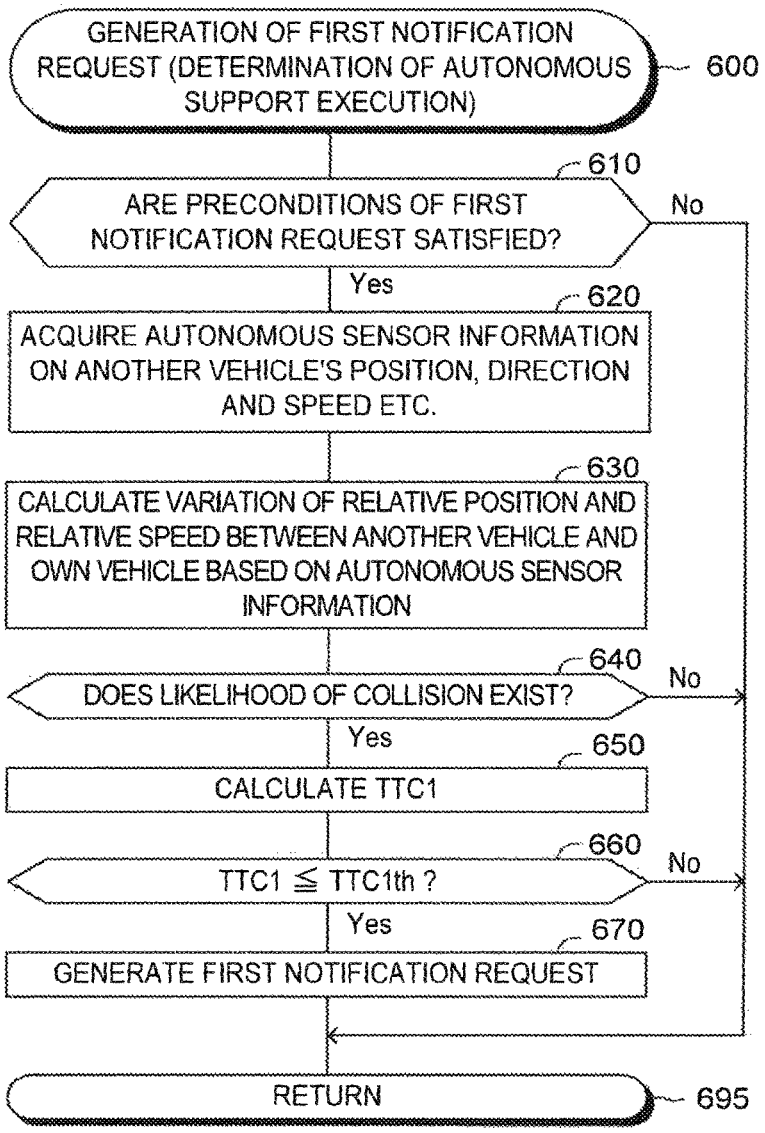
FIG. 6 is a flowchart for illustrating "a first notification request generation routine" executed by the CPU of the ECU which is equipped with the driving support apparatus shown in FIG. 1.

The CPU of ECU 60 is configured so as to repeatedly execute a routine for the first notification request generation routine (autonomous support execution determination routine) shown by a flowchart in FIG. 6 every time a predetermined time (e.g., 20 msec) elapses. Hereinafter, the description will be continued assuming that the preconditions for the first notification request (condition (A1) and condition (A2)) are all satisfied.

At an appropriate point in time, the CPU starts processing from Step 600 to proceed to Step 610, at which the CPU determines whether the preconditions for the first notification request described above are all satisfied. According to the above mentioned assumptions, the preconditions for the first notification request are all satisfied. Thus, the CPU makes a "Yes" determination at Step 610 to proceed to Step 620, at which the CPU acquires the autonomous sensor information which includes the position, the direction, and the speed of another vehicle, using the autonomous sensor 10 (the millimeter wave radar 11 and the stereo camera 12). Thereafter, the CPU proceeds to Step 630, at which the CPU calculates the variations (amounts of fluctuation) per unit time of the relative position and the relative speed between the own vehicle and the another vehicle based on the acquired autonomous sensor information.

Thereafter, the CPU proceeds to Step 640, at which the CPU determines whether a likelihood of a collision between the own vehicle and the another vehicle exists. That is, at Step 640, the CPU determines that the likelihood of the collision exists when a predicted arrival position of the another vehicle at an arbitrary time t exists within a range of vehicle position at the arbitrary time t. On the other hand, the CPU determines that the likelihood of the collision does not exist when the predicted arrival position of the another vehicle at the arbitrary time t exists outside of the range of vehicle position at the arbitrary time t.

When the CPU makes a "No" determination at Step 640, that is, when the CPU determines that the likelihood of the collision does not exist, the CPU directly proceeds to Step 695 to end the present routine tentatively. On the other hand, when the CPU makes a "Yes" determination at Step 640, that is, when the CPU determines that the likelihood of the collision exists, the CPU proceeds to Step 650 to calculate the first time to collision TTC1.

Subsequently, the CPU proceeds to Step 660, at which the CPU determines whether the first time to collision TTC1 is equal to or less than the first threshold time TTC1*th*. When the first time to collision TTC1 is longer than the first threshold time TTC1*th*, the CPU makes a "No" determination at Step 660 to directly proceeds to Step 695 so as to end the present routine tentatively. When the first time to collision TTC1 is equal to or less than the first threshold time TTC1*th*, the CPU makes a "Yes" determination at Step 660 (that is, the CPU determines that the first notification point in time at which the notification that the likelihood of the collision between the own vehicle and the another vehicle exists is provided has come).

Thereafter, the CPU proceeds to Step 670, at which the CPU outputs (generates) the first notification request to the warning determination part 63, and proceeds to Step 695 to end the present routine tentatively.

It should be noted that the CPU makes a "No" determination at Step 610 to directly proceed to Step 695 so as to end the present routine tentatively, if at least one of the preconditions for the first notification request is not satisfied when the CPU executes the process of Step 610.

(Second Notification Request Generation Routine: Inter-Vehicle Communication Type Support Execution Determination Routine)

Figure 7:
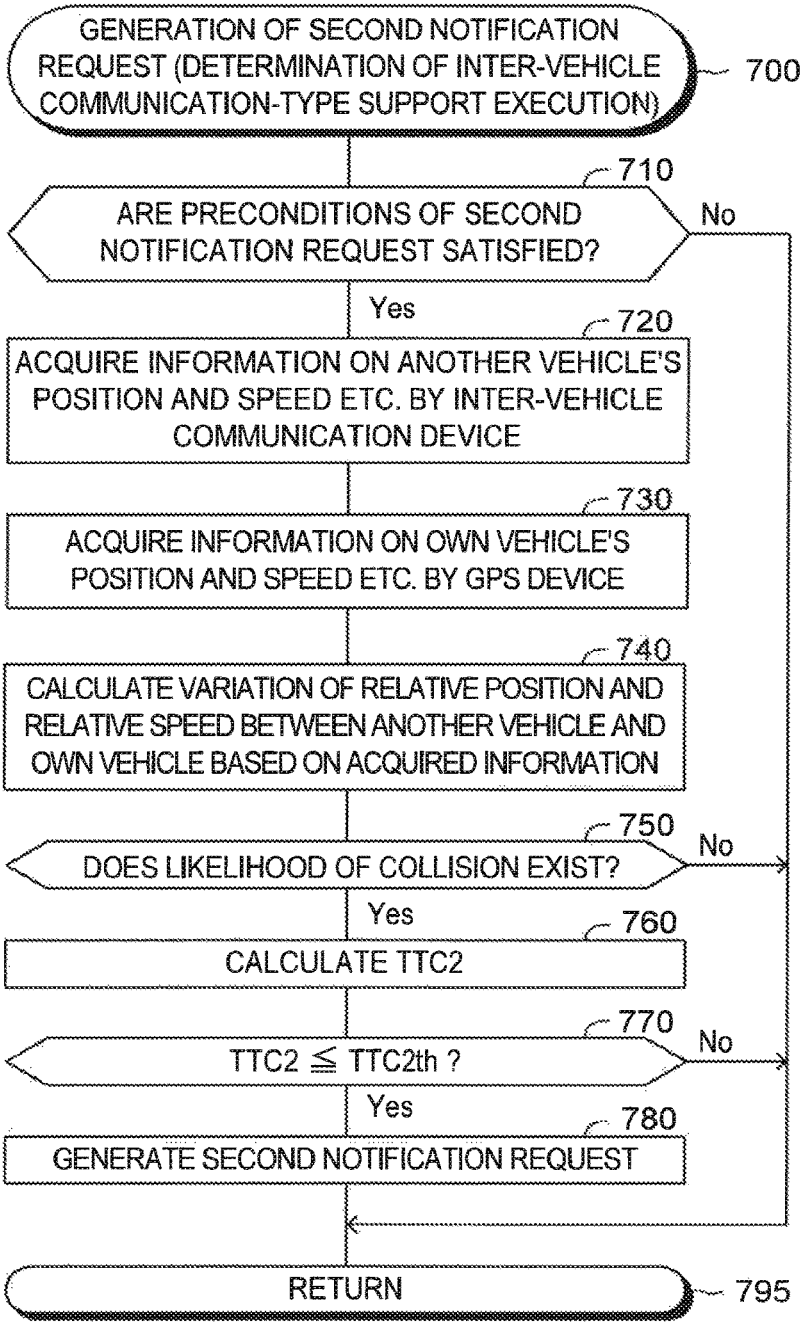
FIG. 7 is a flowchart for illustrating "a second notification request generation routine" executed by the CPU of the ECU which is equipped with the driving support apparatus shown in FIG. 1.

Next, a detailed description will be given of the operation of the second determination part 62. The CPU of the ECU 60 is configured to repeatedly execute a routine for the second notification request generation routine (inter-vehicle communication type support execution determination routine) shown by a flowchart in FIG. 7 every time a predetermined time (e.g., 100 msec) elapses. Hereinafter, the description will be continued assuming that the preconditions for the second notification request (the condition (B1), the condition (B2) and the condition (B3)) are all satisfied.

At an appropriate point in time, the CPU starts processing from Step 700 to proceed to Step 710, at which the CPU determines whether the preconditions for the second notification request described above are all satisfied. According to the assumptions mentioned above, the preconditions for the second notification request are all satisfied. Thus, the CPU makes a "Yes" determination at Step 710 to proceed to Step 720, and acquires information including a position and a speed of another vehicle, using the inter-vehicle communication device 20. Thereafter, the CPU proceeds to Step 730, at which the CPU acquires a position and a speed of the own vehicle using the GPS device 30 and the speed sensor 40, and then proceeds to Step 740. The CPU calculates the variations (amounts of fluctuation) per unit time of the relative position and the relative speed between the own vehicle and the another vehicle based on the information acquired at Step 740.

Thereafter, the CPU proceeds to Step 750, at which the CPU determines whether the likelihood of the collision between the own vehicle and the another vehicle exists. That is, at Step 750, the CPU determines that the likelihood of the collision exists when a predicted arrival position of the another vehicle at an arbitrary time t exists within a range of vehicle position at the arbitrary time t. On the other hand, the CPU determines that the likelihood of the collision does not exist when the predicted arrival position of the another vehicle at the arbitrary time t exist outside of the range of vehicle position at the arbitrary time t.

When the CPU makes a "No" determination at Step 750, that is, when the CPU determinates that the likelihood of the collision does not exist, the CPU directly proceeds to Step 795 to end the present routine tentatively. On the other hand, when the CPU makes a "Yes" determination at Step 750, that is, the CPU determinates that the likelihood of the collision exists, the CPU proceeds to Step 760 to calculate the second time to collision TTC2.

Thereafter, the CPU proceeds to Step 770, at which the CPU determines whether the second time to collision TTC2 is equal to or less than the second threshold time TTC2*th*. When the second time to collision TTC2 is longer than the second threshold time TTC2*th*, the CPU makes a "No" determination at Step 770 to directly proceed to Step 795 so as to end the present routine tentatively. When the second time to collision TTC2 is equal to or less than the second threshold time TTC2*th*, the CPU makes a "Yes" determination at Step 770 (that is, the CPU determines that the second notification point in time at which the notification that the likelihood of the collision between the own vehicle and the another vehicle exists is provided has come).

Thereafter, the CPU proceeds to Step 780, at which the CPU outputs (generates) the second notification request to the warning determination part 63, and proceeds to Step 795 to end the present routine tentatively.

It should be noted that the CPU makes a "No" determination at Step 710 to directly proceed to Step 795 so as to end the present routine tentatively, if at least one of the preconditions for the second notification request is not satisfied when the CPU executes the process of Step 710.

(Second Notification Request Inhibition Determination Routine: Inter-Vehicle Communication Type Support Inhibition Determination Routine)

Figure 8:
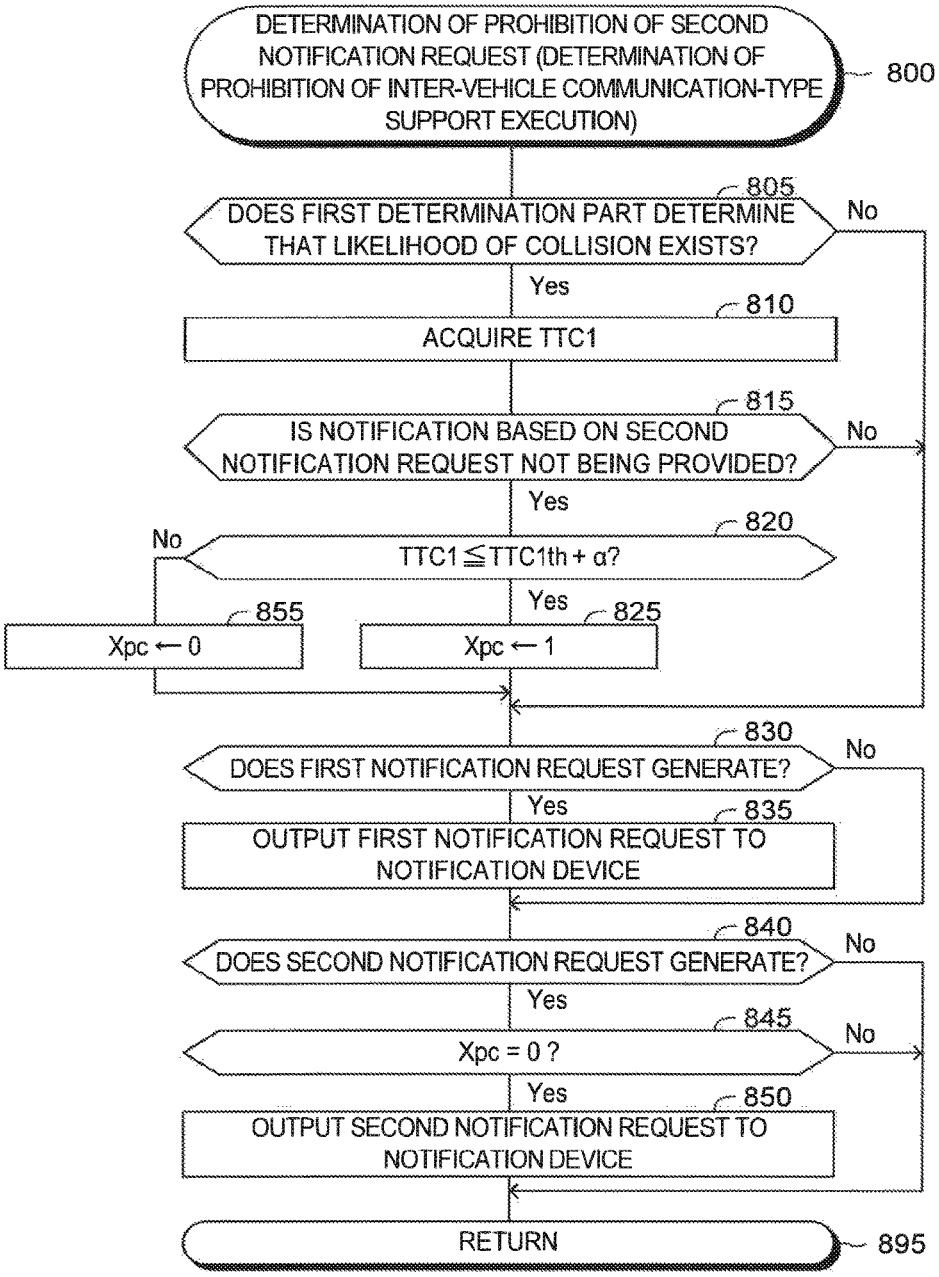
FIG. 8 is a flowchart for illustrating "a second notification request inhibition determination routine" executed by the CPU of the ECU which is equipped with the driving support apparatus shown in FIG. 1.

Next, a detailed description will be given of the operation of the warning determination part 63. The CPU of the ECU 60 is configured to repeatedly execute a routine for the second notification request inhibition determination routine (inter-vehicle communication type support inhibition determination routine) shown by a flowchart in FIG. 8 every time a predetermined time (e.g., 20 msec) elapses.

The CPU starts processing from Step 800 to proceed to Step 805, at which the CPU determines whether it has been determined at Step 640 shown in FIG. 6 that the likelihood of the collision with the another vehicle exists. In other words, the CPU determines at Step 805 whether the first determination part 61 has determined that the likelihood of the collision with the another vehicle exists.

The CPU makes a "Yes" determination at Step 805 to proceed to Step 810, at which the CPU acquires (reads) the first time to collision TTC1 calculated at Step 650 (the first time to collision TTC1 calculated by the first determination part 61), if it has been determined that the likelihood of the collision with the another vehicle exists.

Thereafter, the CPU proceeds to Step 815, at which the CPU determines whether the notification based on the second notification request is not being provided. When the notification based on the second notification is not being provided, the CPU makes a "Yes" determination at Step 815 to proceed to Step 820, at which the CPU determines whether the first time to collision TTC1 is equal to or less than a sum of the first threshold time TTC1*th* and the predetermined time length $\alpha$ (=TTC1*th*+$\alpha$).

When the first time to collision TTC1 is longer than the sum (TTC1*th*+$\alpha$) of the first threshold time TTC1*th* and the predetermined time length $\alpha$, the CPU makes a "No" determination at Step 820 to proceed to Step 855, at which the CPU sets the value of the second notification request inhibition flag Xpc to "0." Thereafter, the CPU proceeds to Step 830.

On the other hand, when the first time to collision TTC1 is shorter than the sum (TTC1*th*+$\alpha$) of the first threshold time TTC1*th* and the predetermined time length $\alpha$, the CPU makes a "Yes" determination at Step 820 to proceed to Step 825, at which the CPU sets the value of the second notification request inhibition flag Xpc to "1." Thereafter, the CPU proceeds to Step 830.

Consequently, the value of the second notification request inhibition flag Xpc is set to "0", if it is estimated that the first notification request will not be generated even after the lapse of the predetermined time length $\alpha$ from the present time (i.e., TTC1>TTC1*th*+$\alpha$). In contrast, the value of the second notification request inhibition flag Xpc is set to "1", if it is estimated that the first notification request will be generated before the lapse of the predetermined time length $\alpha$ from the present time (i.e., TTC1≤TTC1*th*+$\alpha$).

When the CPU proceeds to Step 830, the CPU determines whether the first notification request is being generated. When the first notification request is being generated, the CPU makes a "Yes" determination at Step 830 to proceed to Step 835, at which the CPU outputs (transmits) the first notification request to the notification device 50. Consequently, the notification according to the first notification request (the display for the warning) is provided. Thereafter, the CPU proceeds to Step 840.

In contrast, the CPU makes a "No" determination at Step 830 to directly proceed to Step 840, when the first notification request is not being generated.

When the CPU proceeds to Step 840, the CPU determines whether the second notification request is being generated. When the second notification request is being generated, the CPU makes a "Yes" determination at Step 840 to proceed to Step 845, at which the CPU determines whether the value of the second notification request inhibition flag Xpc is "0."

When the value of the second notification request inhibition flag Xpc is "0", the CPU makes a "Yes" determination at Step 845 to proceed to Step 850, at which the CPU outputs (transmits) the second notification request to the notification device 50. Consequently, the notification according to the second notification request (the display for the warning) is provided. Thereafter, the CPU proceeds to Step 895 to end the present routine tentatively.

On the other hand, when the value of the second notification request inhibition flag Xpc is "1", the CPU makes a "No" determination at Step 845, and directly proceeds to Step 895 so as to end the present routine tentatively. Consequently, the notification according to the second notification request is not provided, even if the second notification request is being generated.

It should be noted that, if it has not been determined that the likelihood of the collision with the another vehicle when the CPU executes the process of Step 805, the CPU makes a "No" determination at Step 805 to directly proceed to Step 830. Furthermore, if the notification according to the second notification request is being provided when the CPU executes the process of Step 815, the CPU makes a "No" determination at Step 815 to directly proceed to Step 830. In addition, if the second notification request has not been generated when the CPU executes the process of Step 840, the CPU makes a "No" determination at Step 840 to directly proceed to Step 895

As description above, the driving support apparatus according to the embodiment of the present invention enables/allows the notification according to the second notification request to be provided, if it is estimated that the first notification request will not be generated even after the lapse of the predetermined time length α from the present time (i.e., TTC1>TTC1*th*+α). In contrast, the driving support apparatus according to the embodiment of the present invention inhibits the notification according to the second notification request from being provided, if it is estimated that the first notification request will be generated before the lapse of the predetermined time length α from the present time (i.e., TTC1≤TTC1*th*+α). Thus, the display of the image is stable and less likely to bother and/or confuse the driver, since the notification contents are not switched in a short time.

<Modification>

The present invention is not limited to the above embodiment, it is possible to adopt various modifications within the scope of the present invention.

For example, the driving support apparatus according to the above described embodiment arbitrates between the notification based on the first notification request (the autonomous warning) and the notification based on the second notification request (the inter-vehicle communication type warning). However, in addition to the arbitration, the driving support apparatus may arbitrate among a road-to-vehicle communication type warning and those warnings. That is, the driving support apparatus may arbitrate between at least two of the autonomous warning, road-to-vehicle communication type warning, and inter-vehicle communication type warning.

A road-to-vehicle communication type support may be adopted at an intersection that has a road-to-vehicle communication apparatus. The road-to-vehicle communication apparatus includes a millimeter wave radar and a stereo camera so as to measure a position, a direction, and a speed of each of another vehicles with the same precision as the autonomous support apparatus. On the other hand, the road-to-vehicle communication type support uses information on the position of the own vehicle that is acquired by the GPS device 30. Thus, the precision of a calculated relative position and a calculated relative speed between the own vehicle and the another vehicle that the road-to-vehicle communication type support apparatus uses is between the precision of the information that the autonomous support apparatus uses and the precision of the information that the inter-vehicle communication type support apparatus uses.

In view of the above, the priority of the warnings given by those apparatuses is the order of the autonomous warning, the road-to-vehicle communication type warning, and the inter-vehicle communication type warning.

That is, (1) The present support apparatus may inhibit the road-to-vehicle communication type support or the inter-vehicle communication type support, when the autonomous support is expected to be initiated in a short time (i.e., when the "warning" is expected to be requested in a period corresponding to the period defined by the predetermined time length α in the above embodiment).

(2) The present support apparatus may inhibit the inter-vehicle communication type support without inhibiting the autonomous support, when the road-to-vehicle communication type support is expected to be initiated in a short time.

(3) The present support apparatus may inhibit neither the autonomous support nor the road-to-vehicle communication type support, when the inter-vehicle communication type support is expected to be initiated in a short time.

In other words, the relationship between the autonomous support and the road-to-vehicle communication type support is the same as the relationship between the autonomous support and the inter-vehicle communication type support, and the relationship between the road-to-vehicle communication type support and the inter-vehicle communication type support is also the same as the relationship between the autonomous support and the inter-vehicle communication type support.

What is claimed is:

1. A driving support apparatus for an own vehicle, the apparatus comprising:

an autonomous sensor configured to acquire information including a position and a speed of another vehicle relative to the own vehicle;

a first determination part configured to use the position and the speed of the another vehicle acquired by the autonomous sensor to determine whether a first notification point in time has come, the first notification point in time being a point in time at which a notification that a likelihood of a collision between the own vehicle and the another vehicle exists is provided, and which generates a first notification request when it is determined that the first notification point in time has come;

an inter-vehicle communication device configured to acquire, from the another vehicle through wireless communication, information including a position of the another vehicle which is acquired based on GPS signals received by the another vehicle and a speed of the another vehicle;

an own vehicle position acquisition configured to receive GPS signals and acquire a position of the own vehicle based on the GPS signals;

an own vehicle speed detection configured to detect a speed of the own vehicle;

a second determination part configured to use the position and the speed of the another vehicle acquired by the inter-vehicle communication device, the position of the own vehicle acquired by the own vehicle position acquisition, and the speed of the own vehicle detected by the own vehicle speed detection to determine whether a second notification point in time has come, the second notification point in time being a point in time at which a notification that a likelihood of a collision between the own vehicle and the another vehicle exists is provided, and which generates a second notification request when it is determined that the second notification point in time has come; and a notification device configured to provide a notification according to the first notification request at the first notification point in time, and to provide a notification according to the second notification request at the second notification point in time, wherein the notification device is configured not to provide the notification according to the second notification request at the second notification point in time, but to provide the notification according to the first notification request at the first notification point in time, if the second notification point in time has come in a period from a point in time earlier than the first notification point in time by a predetermined time length to the first notification point in time.

2. The driving support apparatus according to claim 1, wherein, the first determination part is configured to:

calculate a first time to collision which is a time until the own vehicle collides with the another vehicle based on the position and the speed of the another vehicle acquired by the autonomous sensor, and determine that the first notification point in time has come when the first time to collision becomes equal to or less than a predetermined first threshold time, and the second determination part is configured to:

calculate a second time to collision which is a time until the own vehicle collides with the another vehicle based on the position and the speed of the another vehicle acquired by the inter-vehicle communication device, the position of the own vehicle acquired by the own vehicle position acquisition, and the speed of the own vehicle detected by the own vehicle speed detection, and determine that the second notification point in time has come when the second time to collision becomes equal to or less than a predetermined second threshold time.

* * * * *